US012600516B2

(12) United States Patent
Mansuino et al.

(10) Patent No.: US 12,600,516 B2
(45) Date of Patent: Apr. 14, 2026

(54) WELDING STATION AND METHOD FOR PRODUCING A PACKAGE COMPRISING A HEAT-SEALED WRAPPING

(71) Applicant: SOREMARTEC S.A., Senningerberg (LU)

(72) Inventors: Sergio Mansuino, Alba (IT); Michele Ripa, Alba (IT); Luca Borderi, Sasso Marconi (IT); Andrea Biondi, Bologna (IT)

(73) Assignee: SOREMARTEC S.A., Senningerberg (LU)

( * ) Notice: Subject to any disclaimer, the term of this patent is extended or adjusted under 35 U.S.C. 154(b) by 0 days.

(21) Appl. No.: 19/015,863

(22) Filed: Jan. 10, 2025

(65) Prior Publication Data

US 2025/0229931 A1 Jul. 17, 2025

(30) Foreign Application Priority Data

Jan. 12, 2024 (IT) ..... 102024000000453

(51) Int. Cl.
*B65B 51/14* (2006.01)
*B65B 51/10* (2006.01)

(52) U.S. Cl.
CPC ..... *B65B 51/14* (2013.01); *B65B 2051/105* (2013.01)

(58) Field of Classification Search
CPC . B65B 51/14; B65B 2051/105; B65B 7/2878; B65B 1/02; B29C 65/7885;
(Continued)

(56) References Cited

U.S. PATENT DOCUMENTS 2,422,750 A * 6/1947 Rue ..... B29C 65/568 53/367
4,035,984 A * 7/1977 Gerlach ..... B65B 61/08 53/550

(Continued)

FOREIGN PATENT DOCUMENTS

EP 3160864 A 8/2018
WO 2012/098524 A1 7/2012

(Continued)

OTHER PUBLICATIONS

Italian Search Report for Patent Application No. IT 102024000000453, mailed Jul. 5, 2024, 7 pages.

*Primary Examiner* — Dariush Seif
(74) *Attorney, Agent, or Firm* — Rothwell, Figg, Ernst & Manbeck, P.C.

(57) ABSTRACT

A welding station for producing a wrapping has a support wheel and a welding device housed on the support wheel and having a head assembly that has a welding member, a support body, and a rod axially movable between a retracted position and a forward position. The support body is integral with an axial end of the rod. The welding device has an abutment assembly having an abutment member and a base assembly engaged to the support wheel. The welding device is configurable in an open configuration where the head assembly and the abutment assembly are mutually spaced, the rod is axially retracted, and the abutment member allows the wrapping to be loaded onto and removed from the head assembly, and a welding configuration where the head assembly and the abutment assembly are mutually engaged, the rod is axially forward and the abutment is engaged by the welding member.

32 Claims, 6 Drawing Sheets

(58) Field of Classification Search
CPC ... B29C 65/7847; B29C 65/18; B29C 66/131; B29C 66/112; B29C 66/849; B29C 66/53461
See application file for complete search history.

(56) References Cited

U.S. PATENT DOCUMENTS 4,065,909 A * 1/1978 Mueller ..... B65D 51/20 53/129.1
4,282,699 A * 8/1981 Embro, Jr. ..... B65B 7/164 53/367
4,525,983 A * 7/1985 Libow ..... B65B 11/54 53/469
4,625,498 A * 12/1986 Parsons ..... B65B 7/2814 53/526
4,838,008 A * 6/1989 Hardy ..... B65B 7/2878 53/425
4,930,288 A * 6/1990 Juenkersfeld ..... B29C 66/849 53/367
5,123,227 A * 6/1992 Shibauchi ..... B29C 65/02 53/367
5,802,806 A * 9/1998 Scaliti ..... B65B 11/54 53/221
5,934,046 A * 8/1999 Whittaker ..... B65B 63/04 53/553
6,413,334 B1 * 7/2002 Rittner ..... B29C 66/8432 156/359
6,513,306 B1 * 2/2003 Milano ..... B65B 25/005 53/221
6,637,491 B2 * 10/2003 Massey ..... B29C 66/003 156/581
8,065,862 B2 * 11/2011 Mansuino ..... B65B 25/005 53/221
9,663,253 B2 * 5/2017 Federici ..... B65B 11/50
10,279,938 B2 * 5/2019 Cavazza ..... B65B 41/06
10,894,373 B2 * 1/2021 Scrivani ..... B29C 65/7461
11,691,772 B2 * 7/2023 Hargreaves ..... B31B 50/52 53/478
12,049,339 B2 * 7/2024 Price ..... B29C 65/368
12,258,159 B2 * 3/2025 Rivola ..... B65B 57/02
2003/0230053 A1 * 12/2003 Salicini ..... B65B 11/32 53/466
2004/0206048 A1 * 10/2004 Iuchi ..... B65B 7/164 53/329.2
2005/0160698 A1 * 7/2005 Caffeo ..... B65B 7/2878 53/290
2010/0107568 A1 * 5/2010 Inaba ..... B29C 66/83423 53/370.7
2013/0248107 A1 * 9/2013 Straub ..... B29C 66/8242 156/308.2
2013/0284033 A1 * 10/2013 Bell, Jr. ..... B65B 13/22 100/32
2016/0009427 A1 * 1/2016 Rea ..... B65B 35/18 53/282
2017/0129675 A1 * 5/2017 Terrasi ..... B65B 25/005
2017/0197744 A1 * 7/2017 Larroche ..... B65B 31/028
2017/0305586 A1 * 10/2017 Rizzi ..... B29C 66/8322
2017/0341839 A1 * 11/2017 D'Souza ..... B65D 81/20
2018/0229874 A1 * 8/2018 Harth ..... B65B 39/145
2018/0282001 A1 * 10/2018 Canalini ..... B65B 59/003
2020/0024015 A1 * 1/2020 Furlotti ..... B29C 66/83543
2022/0227510 A1 * 7/2022 Rivola ..... B65B 51/10
2025/0042096 A1 * 2/2025 Haak ..... B29C 66/822
2025/0229931 A1 * 7/2025 Mansuino ..... B65B 51/14

FOREIGN PATENT DOCUMENTS

WO 2015/121838 A2 8/2015
WO 2018/146214 A1 8/2018

* cited by examiner

WELDING STATION AND METHOD FOR PRODUCING A PACKAGE COMPRISING A HEAT-SEALED WRAPPING

CROSS-REFERENCE TO RELATED APPLICATION

This application claims priority to Italian Patent Application No. 102024000000453 filed on Jan. 12, 2024, the entire contents of which is hereby incorporated in its entirety by reference.

TECHNICAL FIELD

The present invention generally relates to the field of packaging consumer products ("commodities"), in a wrapping made of a heat-sealed sheeted material. In particular, the present invention relates to a welding station and a method for producing a heat-sealed wrapping, suitable for preventing the product within it from coming into contact with the atmosphere external to the wrapping.

The present invention finds particular application in the packaging of heat-sensitive, thermolabile or, in general, low-melting temperature products (i.e., products wherein the melting temperature is lower than 50° C.) wherein prolonged proximity to heat sources may cause deterioration and/or damage of the product itself. By way of example only, some products are mentioned below, which may fall under these definitions: chocolate-based products with melting temperatures around 35-37° C.; refrigerator products which are stored between 2° C. and 6° C.; products which are stored at temperatures below 0° C., such as frozen foods, ice cream or similar; or also products which, with proximity to heat sources, lose or modify the organoleptic qualities thereof. As further examples of low-melting products, also outside the food sector, soaps or products for detergents, products for cosmetic use, such as lipsticks, may be mentioned.

PRIOR ART

Devices for producing heat-sealed wrappings are known which are formed by a first portion defining a cavity wherein a product is accommodated, and a second portion applied to the first portion by means of heat-sealing in order to seal the cavity and preserve the contents thereof from contact with air external to the wrapping.

Said devices are generally part of a welding station on board a machine for packaging a given product, and each includes a head provided with a heating element, which is brought into contact with the two portions of the wrapping (in the region wherein they overlap each other) in order to heat them and to weld such portions together, in such a way as to obtain a sealed container.

Welding stations generally have a linear development, with a plurality of welding heads carried by horizontal conveyors, in such a way that the axes of the welding heads are oriented parallel to each other. A pair of wrapping portions to be welded is then transferred sequentially to each welding head, for the mass production of a plurality of wrappings, containing the respective products. However, a welding station configured in this way has a considerable footprint, particularly when production volumes are high.

To overcome this problem, the welding heads could be arranged upon a rotatable wheel, in an angularly spaced manner, in such a way that the axes of such heads are oriented along respective radii of the wheel. In this way, a welding head of advantageously compact shape and size would be obtained.

An example of a welding station configured in this way is known from the document WO 2015/121838 A2, which describes a system for packaging coffee within capsules.

In particular, the capsules each comprise a cup (containing coffee powder), wherein the top edge thereof is surrounded by a flange, whereto a sealing film is applied by means of heat-sealing.

The two parts forming the capsule are coupled by interposing the flange and film between a pair of abutments, movable perpendicularly with respect to the axis of the cup, and a welding head, which compresses the flange and film against said abutments, simultaneously providing heat such as to determine a weld between the peripheral edge of the film and the flange of the cup.

Nevertheless, a welding device configured in this way, although suitable for coupling a film to a rigid or semi-rigid support, such as the cup of a coffee capsule, would not lend itself to making a hermetic wrapping formed by the coupling of two sheeted materials, insofar as in this case at least one of the two sheets does not have a perfectly planar welding surface for the other (as in the case of the aforementioned flange of a coffee capsule), which may result in the presence of voids and imperfections at the interface between the sheets, resulting in the loss of hermeticity.

For example, in the packaging method described in WO 2012/098524 and EP 3160864, relating to the creation of a hermetic wrapping formed from two heat-sealed sheets (which constitutes a preferred embodiment that may be obtained using the welding station and the method according to the invention), a first wrapping sheet is premolded or drawn into a cup or U-shaped configuration, with a radial flange surrounding the opening mouth. Following the introduction of the product into the first sheet thus shaped, a choking operation of the neck of this sheet is preferably performed in order to make the sheet adhere to the product. A second wrapping sheet (generally, in the form of a disk) is then superimposed upon the flange and heat-sealed thereupon along an annular welding region, arranging the two sheets between an abutment and a welding head.

However, the sheet material, when pre-formed or drawn, and possibly further deformed by the choking action, in order to adhere to the surface—perhaps irregular—of a product, naturally tends to crease, causing the resulting flange not to be perfectly planar, on the contrary to appear corrugated and wrinkled, which may result in the presence, even after welding, of channels and passages at the interface between the two sheets wherein air may creep, producing unwanted exchanges between the cavity inside the wrapping and the external environment, with the consequent loss or impairment of the hermetic effect.

SUMMARY OF THE INVENTION

One object of the present invention is to overcome the aforementioned problems.

In particular, one object of the present invention is to provide a welding head and a method for producing a package comprising a heat-sealed wrapping, which allow a hermetic wrapping to be obtained.

A further object is to provide a method for the packaging of a heat sensitive or thermolabile product.

A further object of the present invention is to provide a welding head and a method for producing a package comprising a heat-sealed wrapping with high production capacity, even equal to or greater than 800 packages/minute.

In order to obtain such results, when the welding device is placed on a rotatable wheel, the distribution of the pressure exerted by the welding head on the interface between the two sheets must be as homogeneous as possible.

Uneven distribution of the welding pressure may in fact prevent sufficient flattening of the creases and folds on the sheets thereby compromising the hermeticity of the wrapping.

The negative impact of this effect becomes all the more important the higher the speed of rotation of the welding heads, insofar as inertial phenomena intervene that may hinder the welding process between the sheets.

In order to achieve this effect, the welding member is oscillatingly housed in a cradle formed in a support body, which in turn is carried by the rotatable wheel of the welding station. In this way, the welding member may compensate for any inhomogeneities in the pressure exerted upon the wrapping sheets.

Furthermore, according to a preferred embodiment of the present invention, the welding member comprises a welding element, provided with one or more protruding ridges or ribs, which allow the pressure exerted by the welding member to be concentrated upon enclosed regions of the wrapping sheets, in such a way as to generate localized peak pressures, capable of flattening the creases and folds of the sheets, in such a way as to interrupt any channels that may be created at the interface therebetween.

The aforesaid and other objects and advantages are achieved by a welding station and a method for producing a heat-sealed wrapping as described and claimed herein.

BRIEF DESCRIPTION OF THE DRAWINGS

The functional and structural features of some preferred embodiments of a welding station and a method for producing a heat-sealed wrapping according to the present invention will now be described. Reference is made to the accompanying drawings, wherein.

DETAILED DESCRIPTION

Figure 1:
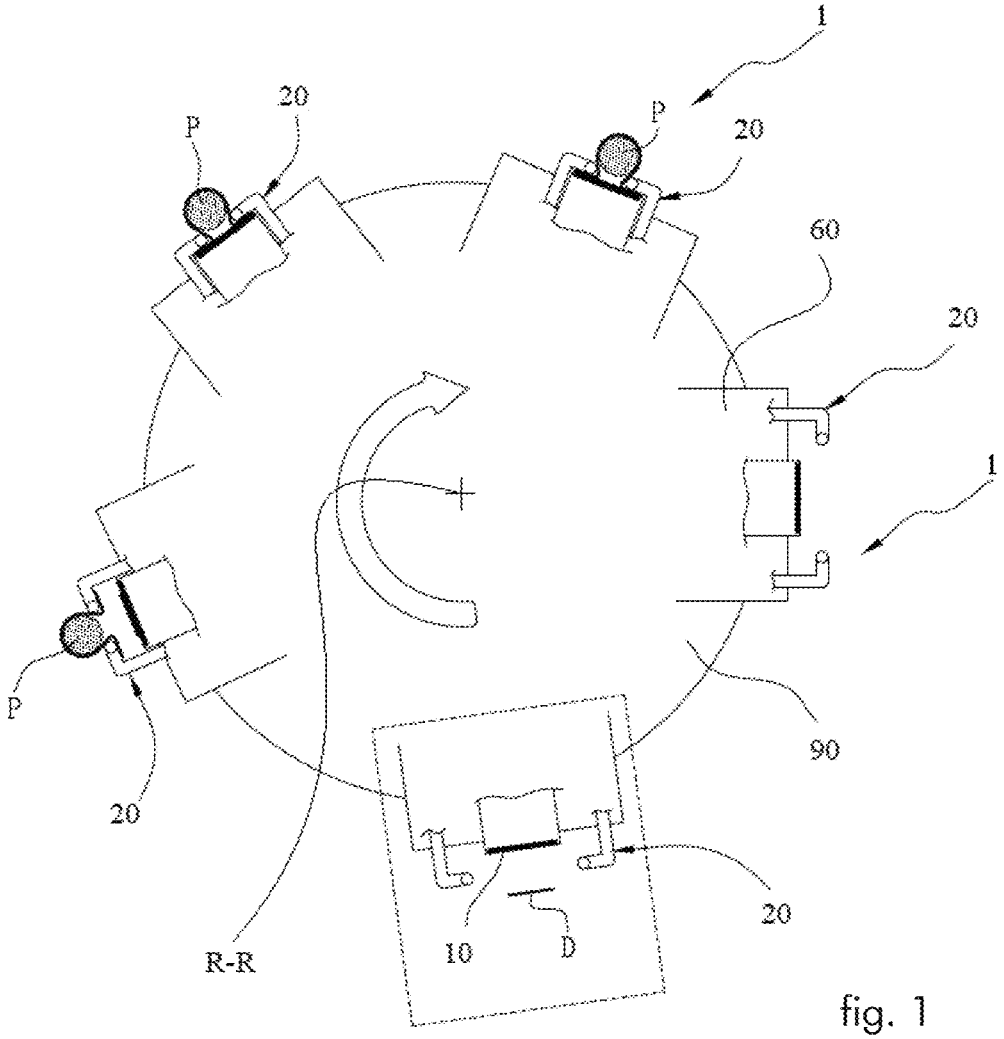
FIG. 1 is a schematic diagram of a welding station according to one embodiment of the present invention, wherein a support wheel and a plurality of welding devices are visible, shown in different operating steps as a function of the angular position thereof upon said wheel.

Before explaining in detail a plurality of embodiments of the present invention, it should be clarified that the present invention is not limited in the application thereof to the design details and configuration of the components presented in the following description or shown in the drawings. The present invention may assume other embodiments and be implemented or constructed in practice in different ways. It should also be understood that the phraseology and terminology have a descriptive purpose and should not be construed as limiting.

The following description refers only by way of non-limiting example to the production of a package of the type described in WO 2012/098524 or EP 3160864, or else generically to the production of a package containing a product as defined above. Furthermore, although the present invention has been developed and is particularly suitable for the purpose of producing a hermetic wrapping, it is understood that the hermeticity of the package is not a limiting constraint, both insofar as it may be easily understood that the advantageous construction features apply equally to the manufacture of a generically heat-sealed wrapping and insofar as the term "hermetic" is not to be understood in an absolute sense, i.e. as referring to the total absence of any exchange of matter between the inside and outside of the packaging.

Furthermore, the sheet material usable in the context of the present invention comprises any packaging material that is itself heat-sealable or provided, at least within the regions thereof that are intended for welding, with a heat-sealable coating. It may be a thermoplastic packaging material, in a single layer, preferably suitable for coming into contact with food, such as polypropylene, or a coupled with two or more layers, such as a laminate or a co-extrusion of aluminum/plastics material, paper/plastics material, optionally including an inner or outer metallization layer.

Thermal-weldability features may be conferred by the application of a heat-sealable lacquer or paint to the surfaces that are intended for welding or within predetermined regions intended for welding.

The sheet packaging material may further include one or more layers of a plastics material with a barrier effect, or else include fillers with an oxygen and/or water vapor barrier effect, as known in the packaging industry.

Referring by way of example to the figures, a welding station according to the present invention will be described below for producing a wrapping comprising at least a first sheet and a second sheet jointly defining a cavity for including a product, wherein the at least first and second sheets are heat-sealed along a welding region surrounding, at least partially, said cavity.

The welding station comprises a support wheel 90, preferably continuously rotatable about a wheel axis R-R, and one or more welding devices 1 housed on the support wheel 90.

In turn, the welding device 1 comprises a head assembly 10, which includes a welding member 11 adapted to come into contact with, support, and transmit heat, until reaching a predetermined welding temperature, to the first sheet of the wrapping, and a support body 16 comprising a radially outer wall 16*a* that internally identifies a cradle wherein the welding member 11 is oscillatingly, at least partially, housed.

A rod 19 is axially movable between a retracted position and a forward position with respect to the wheel axis R-R, wherein the support body 16 is integral with an axial end of the rod 19.

The welding device 1 further comprises an abutment assembly 20 comprising at least one abutment member 21 suitable for providing an abutment to the welding member 11, and a base assembly 60, engaged to the support wheel 90 and supporting the head assembly 10 and the abutment assembly 20.

The welding device 1 is configurable in an open configuration, wherein the head assembly 10 and the abutment assembly 20 are mutually spaced, the rod 19 is axially retracted, and the at least one abutment member 21 is in a position adapted to allow a wrapping to be loaded onto-removed from the head assembly 10, and a welding configuration, wherein the head assembly 10 and the abutment assembly 20 are mutually engaged, the rod 19 is axially forward, and the at least one abutment member 21 is engaged in abutment by the welding member 11.

Figure 5:
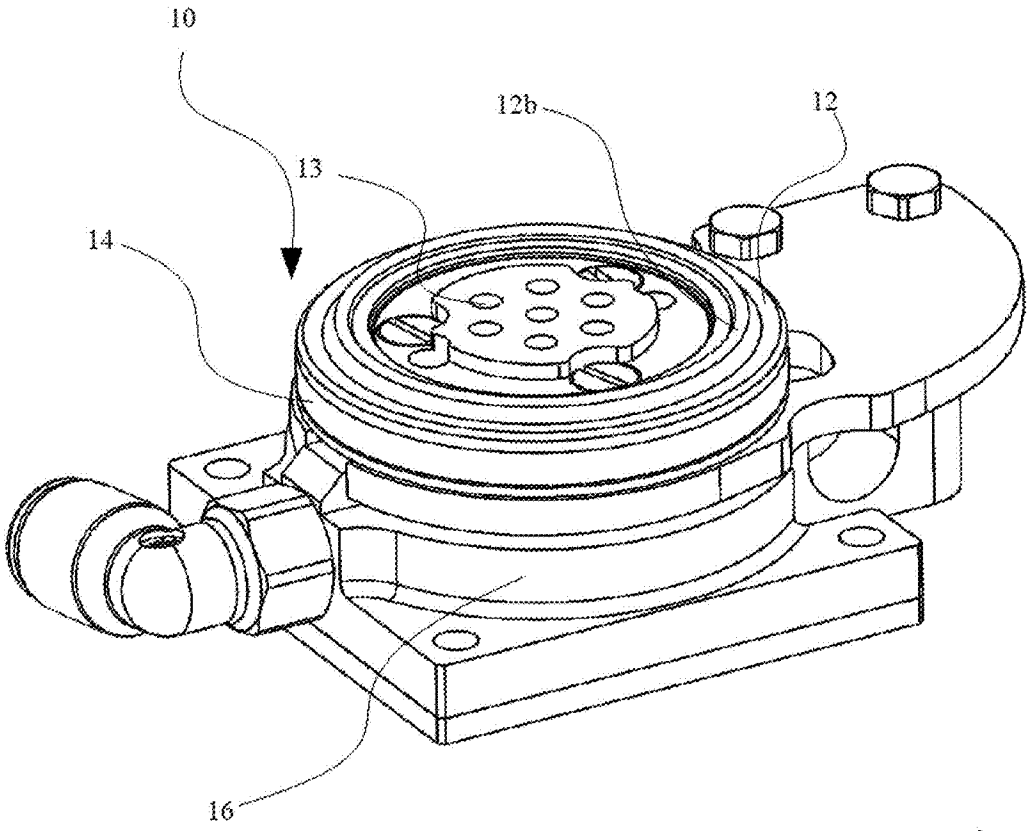
FIG. 5 is a schematic perspective view of a welding member, according to one embodiment of the present invention.
Figure 6:
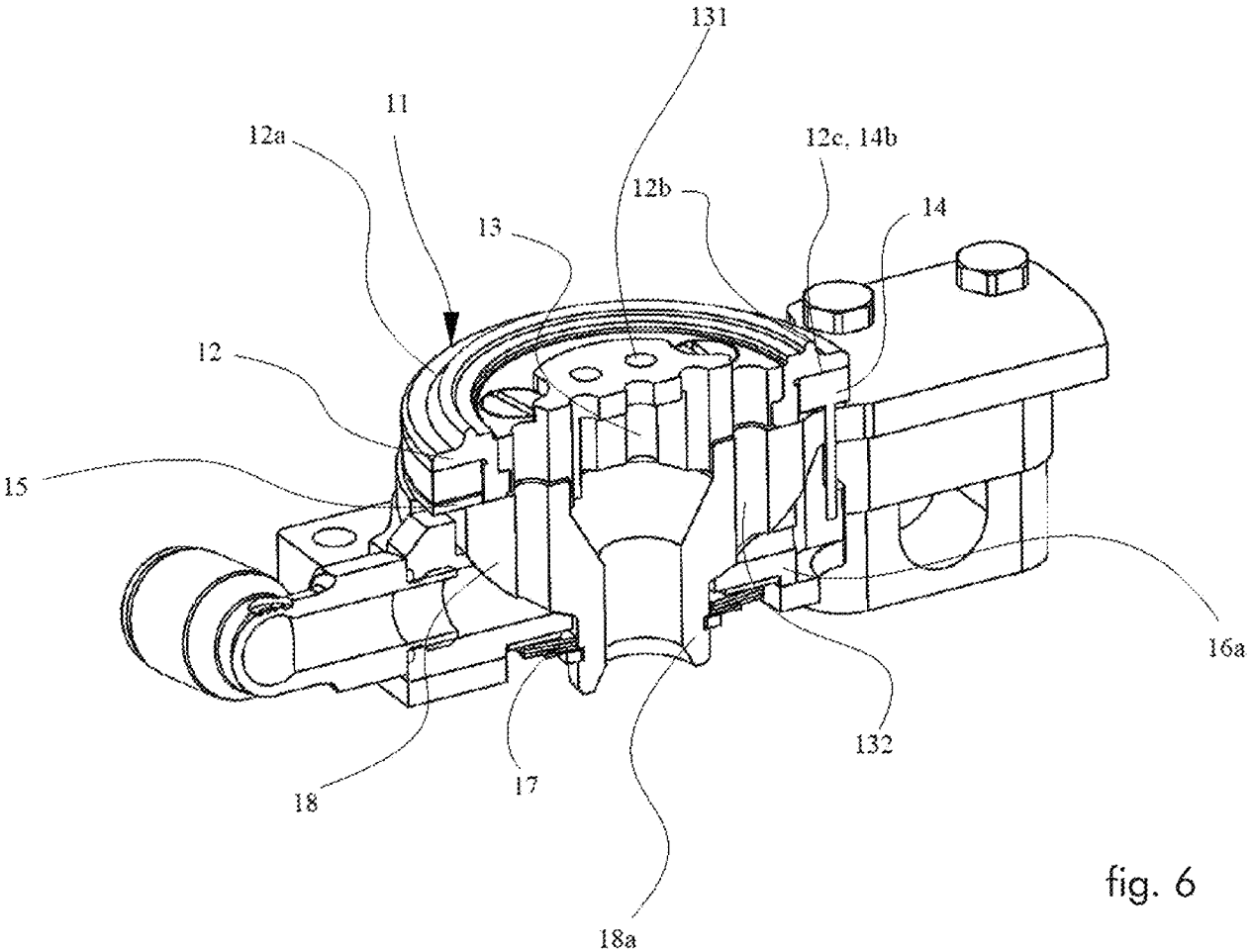
FIG. 6 is a schematic sectional view of the welding member in FIG. 5.

According to a preferred embodiment (schematically shown in FIGS. 5 and 6), the head assembly 10 comprises a skid 18 having an at least partially arched cross-section suitable for slidably engaging the radially outer wall 16*a* that internally defines a cradle.

The skid 18 preferably comprises a projection 18*a*, axially extended from the lower section of the skid 18 in a direction opposite to the welding member 11, and the head assembly 10 comprises an elastic bias means 17, radially interposed between the outer wall 16*a* and the projection 18*a*. The elastic bias means 17 is adapted to push the projection 18*a* towards a condition of coaxiality with respect to the radially outer wall 16*a*.

According to one embodiment, the welding member 11 comprises a welding element 12, having an exposed surface 12*a* adapted to come into contact with, and transmit heat, until reaching a predetermined welding temperature, to the first sheet of the wrapping and having a substantially closed section identifying a central region 13.

According to a preferred embodiment, the welding element 12 is at least partially made of a metallic material, preferably a bronze alloy.

Conveniently, the exposed surface 12*a* of the welding element 12 has at least one projection or protrusion 12*b* preferably of an annular shape, having a top ridge (rounded, cusp-shaped, etc.) defining a narrow welding line or region, i.e., a surface in contact with the sheet capable of locally transmitting to the latter a pressure value greater than the rest of the exposed surface 12*a*. Even more preferably, there may be two or more concentric protrusions 12*b*.

According to a preferred embodiment, the welding member 11 comprises a heating element 14, coaxial and juxtaposed to the welding element 12 on the side of the latter, axially opposite to the exposed surface 12*a*. The heating element 14 comprises an electrical conductor, adapted to produce heat when electrically powered, and a ceramic coating, which embeds said electrical conductor and is adapted to transmit the heat produced by the electrical conductor to the welding element 12. The ceramic coating is in direct contact with the welding element 12.

The heating element 14 is preferably made of a ceramic material having thermal conductivity greater than 50λ (W/mK), more preferably greater than 100λ, and even more preferably greater than 140λ, for example equal to about 170λ.

The ceramic material may be technical ceramic and even more preferably a technical ceramic selected from one of the following categories: silicate ceramic, oxide-ceramic, non-oxide ceramic and piezoceramic.

The fact that the heating element 14 is distinct from the welding element 12 and comprises a ceramic coating allows several advantages to be obtained, in relation, for example, to the fact that, insofar as the ceramic material is thermally conductive, but electrically insulating, it allows optimal heat transmission from the electrical conductor of the heating element 14 to the welding element 12, without the need for an electrical insulating element to be interposed between said two elements 12, 14, which may hinder the transmission of heat. In this way, it is possible to use a traditional bronze or bronze alloy welding element 12, whilst still being able to count on optimal heat transmission from the heating element to the wrapping sheets.

Furthermore, the ceramic materials are perfectly rectifiable, in such a way that the interface between the welding element 12 and the heating element 14 may be precisely planar, without there being any voids or air between the two elements that may hinder the transmission of heat. In fact, preferably, the welding element 12 has, on one side axially opposite the exposed surface 12*a*, a first planar face 12*c*, against which a corresponding second planar face 14*b* of the ceramic coating of the heating element 14 abuts.

According to one embodiment, the head assembly 10 comprises an elastic element 15, interposed between the support body 16 and the heating element 14 and configured in such a way as to push the latter axially against the welding element 12.

Conveniently, the central region 13 comprises at least one suction hole 131 in fluidic communication with a pneumatic source. A fluid flow (preferably air) flows through the suction hole 131 by suction, in order to hold the wrapping (or, at least in the first instance, the first sheet) adhered to the exposed surface 12*a*.

The central region 13 may further comprise cooling holes 132 that are in fluidic communication with a pneumatic source. An outflowing cooling fluid (e.g., air) flows through the cooling holes 132, which cooling fluid is adapted to cool the exposed surface 12*a*. Such feature is particularly advantageous when the product inside the wrapping is of a low-melting type (for example a food or confectionery product or a product such as soaps or products for detergents or for cosmetic use), and it is therefore appropriate to remove as much heat as possible from the welding area, once the wrapping sheets have been welded, in order to prevent the product from suffering from the temperature being too high. The problem of excessive heat becomes all the more important the higher the production speed, because in the absence of forced cooling, it becomes difficult to dispose of the heat between one welding cycle and another, and the temperature would tend to increase locally.

According to a preferred embodiment, the welding element 12 and/or the heating element 14 have an annular shape.

A temperature sensor may also be provided which is adapted to detect the instant temperature of the welding element 12 and/or of the heating element 14 and to generate a signal that is representative of such instant temperature. Such temperature sensor is preferably applied to, or embedded in, the welding element 12 or the heating element 14.

According to a preferred embodiment, the abutment assembly 20 comprises a pair of abutments 21, movable between a closed configuration, where said abutments 21 face the welding member 11 in such a way as to create an axial gap where the wrapping sheets to be welded may be contained, and an open configuration, where the welding member 11 is axially exposed to the outside of the welding device, in such a way as to be able to receive the wrapping of the food product.

According to one embodiment, the abutments 21 comprise respective inserts made of an elastic material at the interface with the welding member 11, adapted to deform at least partially following the profile of the exposed surface 12*a* of the welding member 11. This makes it possible to "copy" the profile (both gibbous and flat) of the welder, optimally distributing the flattening force exerted upon the wrapping sheets.

Conveniently, the welding member 11 is axially movable between a retracted position, wherein the welding member 11 is proximal to the center of the support wheel 90 and is incapable of applying pressure to the wrapping sheets to be welded, and a forward position, wherein the welding member 11 is proximal, in an axial direction, to the at least one abutment member 21 in the closed configuration, in such a way that the welding member 11 may apply pressure in the axial direction to those wrapping sheets to be welded that are retained between the welding member 11 and the at least one abutment member 21.

Figure 2:
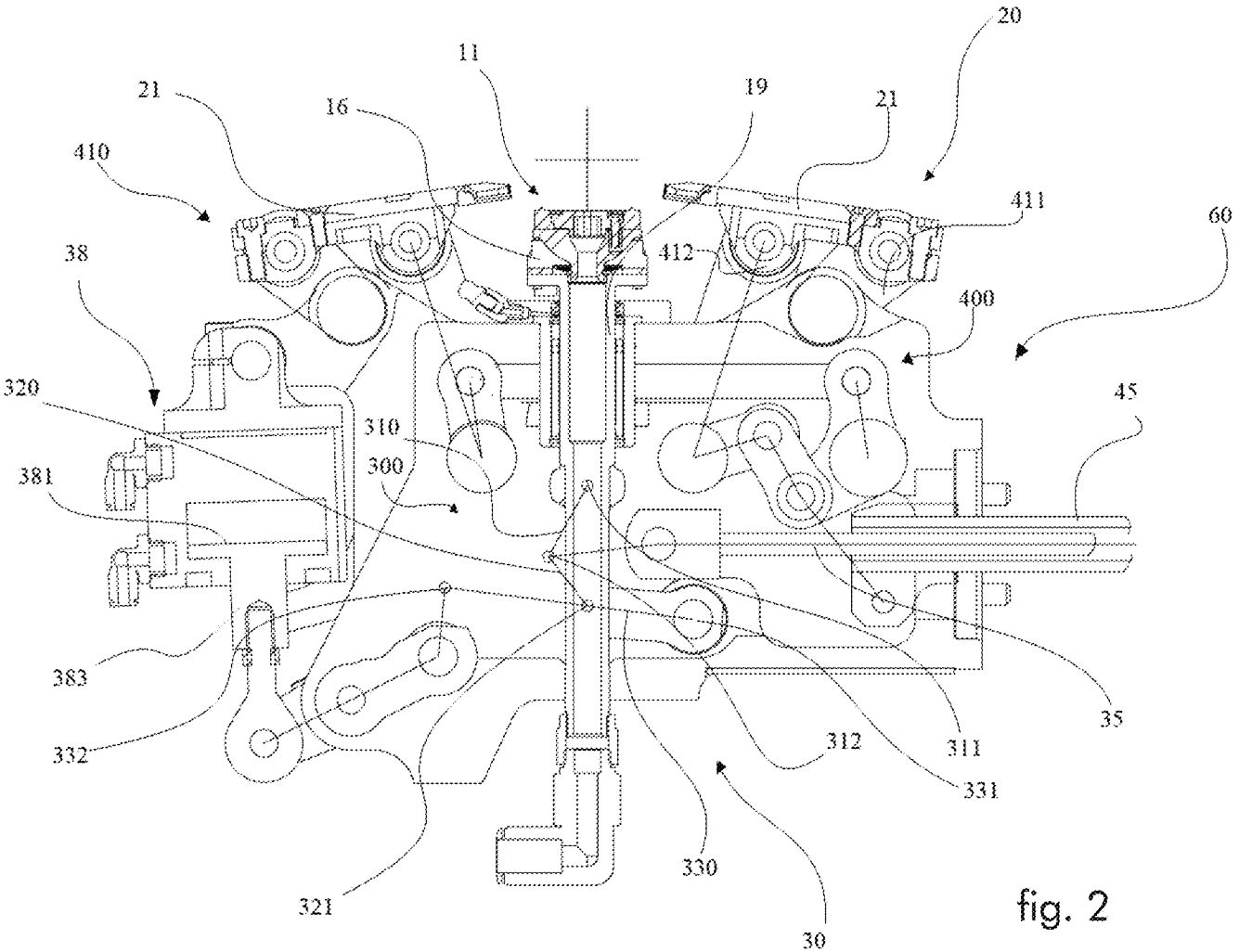
FIGS. 2 to 4 are schematic sectional views of a welding device according to one embodiment of the present invention, showing, respectively, a first step of the welding process wherein the welding member is radially retracted with respect to the support wheel, and the abutment members are open, a second step wherein the welding member is radially forward, and the abutment members are closed, and a third step wherein the welding member is further radially forward, and the abutment members are closed.
Figure 3:
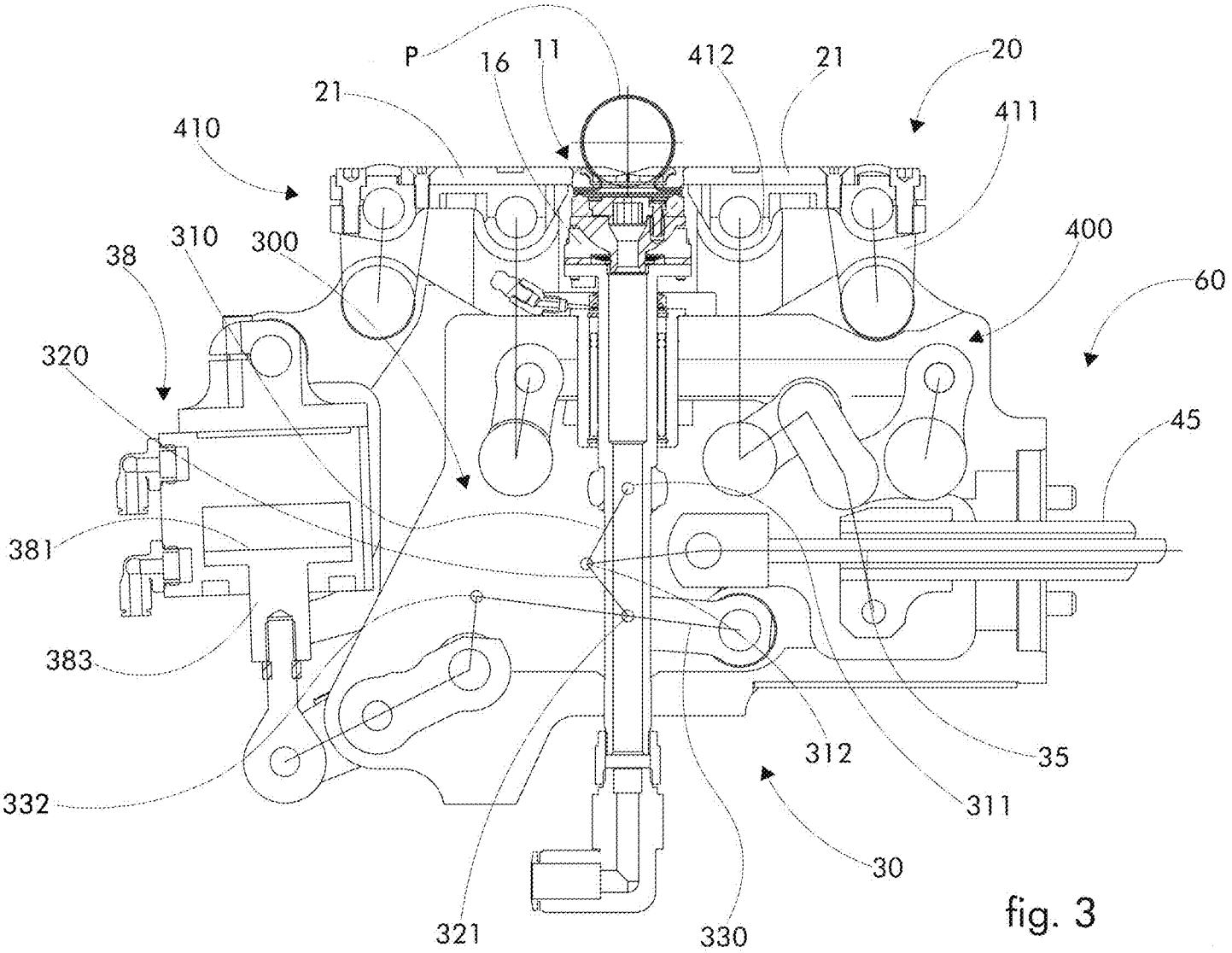
Figure 4:
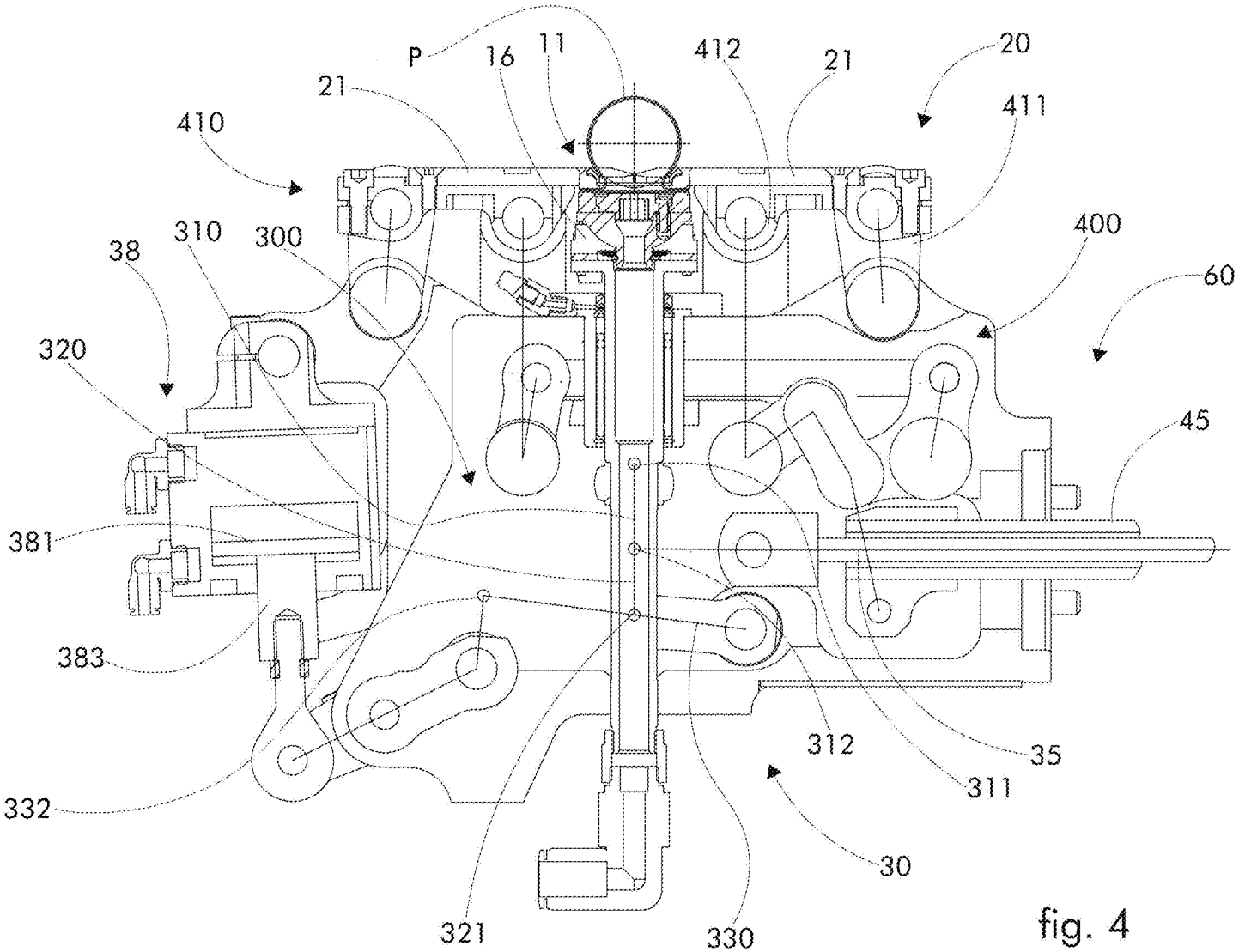

According to a preferred embodiment (schematically illustrated in FIGS. 2 to 4), the welding device 1 comprises a primary kinematic mechanism 30 for controlling the head assembly 10 configurable in a thrust configuration, wherein it pushes the rod 19 towards the forward position, and in an open configuration, wherein it allows the axial movement of the rod in a retracted configuration.

The primary kinematic mechanism 30 may comprise a primary linkage 300 which includes a toggle mechanism formed by two mutually articulated rods. In particular, a first rod 310 of the toggle mechanism is hinged, at a first end, to a first pivot 311, movable integrally with the rod 19, and at the opposite end to a second pivot 312, movable in a direction perpendicular to the axis of the rod 19 between a first position, wherein the second pivot 312 is not aligned with the first pivot 311 along the axis of the rod 19, and a second position, wherein the second pivot 312 is aligned with the first pivot 311 along the axis of the rod 19. A second rod 320 of the toggle mechanism is instead hinged, at a first end, to the second pivot 312, and at the opposite end to a third pivot 321 that is axially aligned with the first pivot 311. The primary linkage 300 is configured in such a way that when the three pivots 311, 312, 321 are not mutually aligned, the rod 19 is in the retracted position, and when the three pivots 311, 312, 321 are mutually aligned, the rod 19 is in the forward position. With a mechanism configured in this way, it is possible to obtain high rod 19 thrust values, without having to resort to architecturally overly complex solutions, insofar as a small spatial stroke of the pivots is sufficient to generate a considerable thrust, which will be transmitted from the rod 19 to the welding member 11, and from the latter to the wrapping sheets.

The primary kinematic mechanism 30 preferably comprises a primary control actuator 35 engaged to the second pivot 312 in order to move it linearly along a direction perpendicular to the axis of the rod 19.

The primary kinematic mechanism 30 may further comprise a third rod 330 having an end 331 hinged to the base assembly 60 and the free end 332 opposite the hinged end 331, and an auxiliary actuator 38 (which may be operated as an alternative or in combination with the primary control actuator 35). In such a configuration, the third pivot 321 is preferably integral with the third rod 330, and the welding device is configured in such a way that the third pivot 321 tends to shift axially along the rod 19 towards the abutments 21 when the auxiliary actuator 38 performs a thrust action (i.e., adapted to push the welding member 11 towards the abutments 21).

The auxiliary actuator 38 may also be operable in such a way as to retract the welding member 11 with respect to the abutments 21, also independently of the action of the primary control actuator 35 and/or the rotation speed of the support wheel 90, in such a way as to cause the welding member 11 to detach from the wrapping. This may protect the product from damage due, for example, to the prolonged stopping of the system (preventing excessive heat from being transmitted to the product due to the machine stoppage). The auxiliary actuator 38 is preferably operable in such a way as to keep the welding member 11 in contact with the wrapping sheet for a predetermined time, irrespective of the rotation speed of the support wheel 90.

The auxiliary actuator 38 may be a pneumatic actuator comprising a cylinder which defines a chamber wherein is slidably housed a piston 381 mechanically connected to the third rod 330, by means of a piston rod 383 projecting outside of the cylinder, the piston 381 being movable within the cylinder in response to an action carried out by the third pivot 321 on the third rod 330 and to the reaction opposed by the pressure within the chamber.

By virtue of the auxiliary actuator 38, it is possible to obtain an axial thrust on the rod 19 that is an alternative or additional to that produced by the primary linkage 300.

The welding device 1 may further comprise a secondary kinematic mechanism 40 for controlling the abutment assembly 20 which is configurable in a thrust configuration, wherein it pushes the abutment assembly 20 in order to open relative to the welding member 11, and in a closed configuration, wherein the at least one abutment member 21 is arranged facing the head assembly 10 in such a way as to define an abutment surface for the wrapping sheets when the welding member 11 is in the forward position.

The secondary kinematic mechanism 40 may comprise a secondary linkage 400 comprising at least one parallelogram device 410, comprising a first parallelogram rod 411 and a second parallelogram rod 412, engaged to the abutment member 21 for guiding it in rototranslation. In such a configuration, the secondary kinematic mechanism 40 allows the thrust of the welding member 11 to be discharged substantially radially with respect to the support wheel 90.

Preferably, the secondary kinematic mechanism 40 comprises a secondary control actuator 45 engaged to the secondary linkage 400, adapted for moving linearly.

Conveniently, the primary control actuator 35 and the secondary control actuator 45 are controllable in linear movement by a cam device housed in the support wheel 90. This simplifies the architecture of the machine insofar as there is a single actuation for the two actuators.

According to a preferred embodiment, the primary control actuator 35 houses the secondary control actuator 45 or vice versa.

The welding station preferably comprises a plurality of welding devices 1 supported by the support wheel 90 in an angularly equidistant manner, wherein each rod 19 is aligned to respective radii of the support wheel 90.

According to one embodiment, the base assembly 60 of the at least one welding device 1 is oscillatingly supported by the support wheel 90 about a relevant oscillation axis, parallel and not coincident with the wheel axis R-R.

According to a further aspect of the invention, a method for producing a wrapping comprising at least a first sheet and a second sheet jointly defining a cavity adapted to include a product comprises the steps of:

a) providing a support wheel 90, continuously rotatable about a wheel axis R-R, and at least one welding device 1 housed on the support wheel 90, the welding device 1 comprising a welding member 11 translatable along a radial direction of the support wheel 90 and suitable for coming into contact with, and providing heat, until a predetermined temperature is reached, to a first sheet of the wrapping, and an abutment assembly 20 comprising at least one abutment member 21 suitable for providing an abutment to the welding member 11;

b) when the support wheel 90 is in a first angular position, arranging the welding member 11 in a retracted position with respect to the abutment assembly 20 and configuring the latter in a first open position, then feeding a first sheet of the wrapping to the welding device 1, arranging the first sheet in contact with the welding member 11;

c) when the support wheel 90 is in a second angular position, subsequent to the first angular position, in the direction of rotation of the support wheel 90, feeding a second sheet of the wrapping previously shaped in such a way as to define a cavity containing the product, so that it overlaps at least partially with the first sheet along a welding region;

d) arranging the abutment member 21 of the abutment assembly 20 into a closed position, preferably with a rototranslatory movement, in such a way that it faces at least partially the second sheet, overlapping the welding region;

e) when the support wheel 90 is in a third angular position, subsequent to the second one in the direction of rotation of the support wheel 90, advancing the welding member 11 in such a way as to exert a predetermined pressure against the abutment assembly 20, and heating the welding member 11 to a predetermined temperature, so as to mutually weld the first and second sheets; and f) when the support wheel 90 is in a fourth angular position, subsequent to the third one in the direction of rotation of the support wheel 90, arranging the welding member 11 into the retracted position and returning the abutment assembly 20 to the first open position, and removing the wrapping from the welding device 1.

According to one embodiment, step e) is performed by translating the welding member 11 towards the abutment member 21 by means of a primary kinematic mechanism 30, in such a way as to impart a first level of pressure to the overlapping wrapping sheets. The primary kinematic mechanism 30 preferably comprises a primary linkage 300 which includes a toggle mechanism formed by two mutually articulated rods, one hinged to the welding member 11 and the other to a different support (with respect whereto the welding member 11 is movable), in such a way that, when such rods are aligned with each other, the welding member 11 is made to translate towards the abutment member 21, imparting said first pressure level to the overlapping wrapping sheets. Preferably, the primary kinematic mechanism 30 comprises a primary control actuator 35 engaged to the toggle mechanism in order to alternately bring the rods thereof into a mutually aligned and misaligned configuration (the latter corresponding to a condition wherein the pressure of the welding member 11 against the wrapping sheets is reduced/zeroed, and/or the welding member 11 is brought into a retracted position with respect to the abutment member 21).

Step e) is preferably carried out by exerting an additional thrust on the welding member 11 by means of an auxiliary actuator 38, mechanically connected to the primary kinematic mechanism 30, in such a way as to impart to the overlapping wrapping sheets a second level of pressure that is greater than the first. This may be performed, for example, by mechanically connecting the auxiliary actuator 38 to the support with which one of the two toggle rods of the primary kinematic mechanism 30 is hinged (a support which in turn may include a third rod), and by actuating the auxiliary actuator 38 in such a way that, when the two toggle rods are mutually aligned, the primary kinematic mechanism 30 transmits thrust to the welding member 11 from the auxiliary actuator 38 (possibly additional to the thrust exerted at first by the primary kinematic mechanism 30).

According to one embodiment, a step of arranging the welding member 11 into a retracted position, downstream of the completed welding, is performed by means of a command imparted by the auxiliary actuator 38, for example also when the primary kinematic mechanism 30 is still in the initial thrust configuration. This may be performed, for example, by actuating the auxiliary actuator 38 in such a way that, even when the two toggle rods of the primary kinematic mechanism 30 are still mutually aligned, the support whereto one of such two rods is hinged (the one not hinged to the welding member 11) yields relative to the welding member 11, causing the latter to retract relative to the abutment member 21. The actuation of the auxiliary actuator 38 in order to arrange the welding member 11 into a retracted position, also when the primary kinematic mechanism 30 is still in the initial thrust configuration, allows the time wherein the welding member 11 remains in contact with the wrapping sheets to be adjusted in order to prevent an excessive amount of heat from being transmitted to the product. Step f) preferably comprises a step of keeping the welding member 11 in contact with the wrapping sheets for a predetermined time, regardless of the rotation speed of the support wheel 90. The welding member 11 may for example be arranged into a retracted position downstream of step e) above, in such a way as to detach the welding member 11 from the wrapping sheets, even when the rotation speed of the support wheel 90 is low or zero (which could lengthen the time that the welding member 11 is in contact with the wrapping sheets).

According to one embodiment, step b) is carried out by exerting a suction action so as to hold the first sheet adhered to the welding member 11.

Preferably, downstream of step f) above, there is the step of blowing a cooling fluid (e.g., air) onto the welding member 11, so as to cool it until a predetermined temperature is reached.

According to a preferred embodiment of the present invention, there is also the step of instantaneously detecting the temperature of at least part of the welding member 11. Temperature data may be used, for example, in order to adjust the power of the heating element 14 and/or to blow a cooling fluid (preferably air) onto the welding member 11.

According to a further aspect of the present invention, it is possible to obtain, by means of a welding station and/or a method according to the invention, a package comprising a wrapping (preferably hermetic) which includes a first sheet (conveniently, in the form of a disk) and a second sheet (comprising an annular flange), such sheets jointly defining a cavity containing a product (as previously defined), wherein the first and second sheets are superimposed along an annular contact region (at least partially coinciding with a surface of the annular flange, facing towards the first sheet), and heat-sealed along at least one annular welding region, contained in the annular contact region. Such annular welding region may conveniently be shaped as an imprint imparted upon the sheets (preferably, in a closed circular shape), within the annular contact region. There is preferably a plurality of said annular welding regions, which are mutually concentric.

Furthermore, the rotatable wheel welding station, according to the present invention, finds application particularly as a component of a continuous packaging apparatus, comprising a rotatable wheel feeding station, upstream of the welding station, supplied with equipment adapted to receive and draw a sheet in order to accommodate a product to be packaged. Conveniently, the feeding station is configured to shape the sheet in such a way that it has an annular flange surrounding the opening mouth. Such a set of sheet and product emerging from the feeding station are thus delivered to the welding station according to the invention, after feeding to the latter an additional sheet, which is coupled to and heat-sealed to such an annular flange in order to form a preferably hermetic wrapping containing the product. The object thus obtained is then picked up or ejected from the welding station, and optionally delivered to further processing or handling stations, downstream of the welding station.

Various aspects and embodiments of a welding station and method for producing a hermetic wrapping according to the present invention have been described. It is understood that each embodiment may be combined with any other embodiment. Moreover, the present invention is not limited to the embodiments described, but may be varied within the scope defined by the appended claims.

What is claimed is:

1. A welding station for producing a wrapping comprising at least a first sheet and a second sheet jointly defining a cavity for including a product, wherein the at least first and second sheets are heat-sealed along a welding region at least partially surrounding said cavity, wherein the welding station comprises a support wheel rotatable about a wheel axis, and one or more welding devices housed on the support wheel and comprising:

(i) a head assembly comprising:

a welding member adapted to come into contact with, support, and transmit heat, until a predetermined welding temperature is reached, to the first sheet of the wrapping;

a support body comprising a radially outer wall which internally defines a cradle wherein the welding member is at least partially housed, in an oscillating way; and a rod axially movable between a retracted position and a forward position relative to the wheel axis, the support body being integral with an axial end of the rod;

(ii) an abutment assembly comprising at least one abutment member suitable for providing an abutment to the welding member; and (iii) a base assembly engaged to the support wheel and supporting the head assembly and the abutment assembly;

wherein the one or more welding devices are configurable in an open configuration, where the head assembly and the abutment assembly are mutually spaced, the rod is axially retracted, and the at least one abutment member is in a position adapted to allow the wrapping to be loaded onto/removed from the head assembly, and a welding configuration, where the head assembly and the abutment assembly are mutually engaged, the rod is axially forward and the at least one abutment member is engaged in abutment by the welding member.

2. The welding station of claim 1, wherein the head assembly further comprises a skid having an at least partially arched cross-section suitable for slidingly engaging the radially outer wall.

3. The welding station of claim 2, wherein the skid comprises a projection axially extended from a lower section of the skid in a direction opposite to the welding member, and wherein the head assembly further comprises an elastic bias means radially interposed between the radially outer wall and the projection, the elastic bias means being adapted to push the projection towards a condition of coaxiality in relation to the radially outer wall.

4. The welding station of claim 1, wherein the welding member comprises a welding element provided with an exposed surface adapted to come into contact with, and transmit heat, until a predetermined welding temperature is reached, to the first sheet of the wrapping, and having a substantially closed section identifying a central region.

5. The welding station of claim 4, wherein the exposed surface of the welding element has at least one protrusion of an annular shape, having a top ridge defining a welding line.

6. The welding station of claim 4, wherein the central region comprises at least one suction hole through which a suction fluid flow flows, in order to hold the wrapping adhered to the exposed surface, the at least one suction hole being in fluidic communication with a pneumatic source.

7. The welding station of claim 4, wherein the central region comprises cooling holes through which an outflowing fluid flows adapted to cool the exposed surface, the cooling holes being in fluidic communication with a pneumatic source.

8. The welding station of claim 4, further comprising a heating element, coaxial and juxtaposed to the welding element on a side of the welding element axially opposite to the exposed surface, the heating element comprising an electrical conductor adapted to produce heat when electrically powered, and a ceramic coating embedding the electrical conductor and suitable for transmitting the heat produced by the electrical conductor to the welding element, the ceramic coating being in direct contact with the welding element.

9. The welding station of claim 8, wherein the welding element comprises, on the side thereof axially opposite to the exposed surface, a first planar face, against which a corresponding second planar face of the ceramic coating of the heating element abuts.

10. The welding station of claim 8, wherein the head assembly further comprises an elastic element interposed between the support body and the heating element, and configured to axially push the heating element against the welding element.

11. The welding station of claim 8, further comprising a temperature sensor capable of detecting an instant temperature of the welding element and/or the heating element, and generating a signal representative of said instant temperature.

12. The welding station of claim 11, wherein the temperature sensor is applied to, or embedded in, the welding element or the heating element.

13. The welding station of claim 1, wherein the abutment assembly comprises a pair of abutments movable between a closed configuration, wherein said abutments face the welding member so as to create an axial gap in which the at least first and second sheets of the wrapping to be welded may be contained, and an open configuration, wherein the welding member is axially exposed to an outside of the welding device, so as to receive the wrapping of the product.

14. The welding station of claim 13, wherein the welding member is axially movable between a retracted position, wherein the welding member is proximal to a center of the support wheel and is incapable of applying pressure to the at least first and second sheets of the wrapping to be welded, and a forward position, wherein the welding member is proximal in an axial direction to the pair of abutments in the closed configuration, such that the welding member may apply pressure in the axial direction to the at least first and second sheets of the wrapping to be welded which are held between the welding member and the pair of abutments.

15. The welding station of claim 1, further comprising a primary kinematic mechanism for controlling the head assembly, which is configurable in a thrust configuration, wherein the primary kinematic mechanism pushes the rod towards the forward position, and in an open configuration, wherein the primary kinematic mechanism allows for axial motion of the rod in the retracted position.

16. The welding station of claim 15, wherein the primary kinematic mechanism comprises a primary linkage including a toggle mechanism formed by two mutually articulable rods, wherein:

a first rod of the toggle mechanism is hinged, at a first end, to a first pivot, movable integrally with the rod, and at an opposite end to a second pivot, movable in a direction perpendicular to an axis of the rod between a first position, wherein the second pivot is not aligned to the first pivot along the axis of the rod, and a second position, wherein the second pivot is aligned to the first pivot along the axis of the rod; and a second rod of the toggle mechanism is hinged, at a first end, to the second pivot, and at an opposite end to a third pivot, axially aligned to the first pivot;

the primary linkage being configured in such a way that, when the first, second and third pivots are not mutually aligned, the rod is in the retracted position, and when the first, second and thirds pivots are mutually aligned, the rod is in the forward position.

17. The welding station of claim 16, wherein the primary kinematic mechanism further comprises a primary control actuator engaged at the second pivot in order to move the second pivot linearly along the direction perpendicular to the axis of the rod.

18. The welding station of claim 16, wherein:

the primary kinematic mechanism further comprises a third rod having an end hinged to the base assembly, and a free end opposite the hinged end;

the third pivot is integral to the third rod;

the primary kinematic mechanism further comprises an auxiliary actuator; and the welding device is configured so that the third pivot tends to axially translate along the rod towards the abutments when the auxiliary actuator performs a thrust action.

19. The welding station of claim 18, wherein the auxiliary actuator is operable in such a way as to keep the welding member in contact with the wrapping for a predetermined time, irrespective of a rotation speed of the support wheel.

20. The welding station of claim 19, wherein the auxiliary actuator is a pneumatic actuator comprising a cylinder which defines a chamber wherein is slidingly housed a piston mechanically connected to the third rod by a piston rod projecting outside of the cylinder, the piston being movable within the cylinder in response to an action carried out by the third pivot on the third rod and to a reaction opposed by a pressure within the chamber.

21. The welding station of claim 1, further comprising a secondary kinematic mechanism for controlling the abutment assembly, which is configurable in a thrust configuration, wherein the secondary kinematic mechanism pushes the abutment assembly in order to open relative to the welding member, and in a closed configuration, wherein the at least one abutment member is arranged facing the head assembly in such a way as to define an abutment surface for the at least first and second sheets of the wrapping when the welding member is in the forward position.

22. The welding station of claim 21, wherein the secondary kinematic mechanism further comprises a secondary linkage comprising at least one parallelogram device comprising a first parallelogram rod and a second parallelogram rod, engaged with the at least one abutment member for guiding the at least one abutment member in rototranslation.

23. The welding station of claim 22, wherein the secondary kinematic mechanism further comprises a secondary control actuator engaged with the secondary linkage, suitable for moving linearly.

24. The welding station of claim 1, comprising on the support wheel a plurality of angularly equidistant welding devices, wherein each rod is aligned to respective radii of the support wheel.

25. The welding station of claim 1, wherein the base assembly of the at least one welding device is oscillatingly supported by the support wheel about a relevant oscillation axis, parallel to and not coincident with the wheel axis.

26. A method for producing a wrapping comprising at least a first sheet and a second sheet that jointly define a cavity suitable for including a product, the method comprising steps of:

a) providing a support wheel, continuously rotatable about a wheel axis, and at least one welding device housed on the support wheel, the at least one welding device comprising a welding member translatable along a radial direction of the support wheel and suitable for coming into contact with, and providing heat, until a pre-determined temperature is reached, to the first sheet of the wrapping, and an abutment assembly comprising at least one abutment member suitable for providing an abutment to the welding member;

b) when the support wheel is in a first angular position, arranging the welding member in a retracted position with respect to the abutment assembly and configuring the abutment assembly in a first open position, then feeding the first sheet of the wrapping to the at least one welding device, arranging the first sheet in contact with the welding member;

c) when the support wheel is in a second angular position, subsequent to the first angular position in a direction of rotation of the support wheel, feeding the second sheet of the wrapping previously shaped so as to define the cavity containing the product, so that the second sheet overlaps at least partially with the first sheet along a welding region;

d) arranging the at least one abutment member of the abutment assembly into a closed position, preferably with a rototranslatory movement, in such a way that the at least one abutment member faces at least partially the second sheet, overlapping the welding region;

e) when the support wheel is in a third angular position, subsequent to the second angular position in the direction of rotation of the support wheel, advancing the welding member so as to exert a predetermined pressure against the abutment assembly, and heating the welding member to a predetermined temperature, so as to mutually weld the first and second sheets; and f) when the support wheel is in a fourth angular position, subsequent to the third angular position in the direction of rotation of the support wheel, arranging the welding member into the retracted position and returning the abutment assembly to the first open position, and removing the wrapping from the at least one welding device.

27. The method of claim 26, wherein step e) is carried out by translating the welding member towards the at least one abutment member by a primary kinematic mechanism, in such a way as to impart a first level of pressure to the overlapping sheets of the wrapping, and by exerting a supplementary thrust against the welding member by an auxiliary actuator, mechanically connected to the primary kinematic mechanism, in such a way as to impart to the overlapping sheets of the wrapping a second level of pressure that is greater than the first level of pressure.

28. The method of claim 27, wherein step f) comprises holding the welding member in contact with the first and second sheets for a predetermined time, irrespective of a rotation speed of the support wheel.

29. The method of claim 27, comprising a step of arranging the welding member into the retracted position, downstream of the completed welding, by a command exerted by the auxiliary actuator to the primary kinematic mechanism.

30. The method of claim 26, wherein step b) is carried out by exerting a suction action so as to hold the first sheet adhered to the welding member.

31. The method of claim 26, wherein, downstream of step f), the method comprises a step of blowing a cooling fluid onto the welding member, so as to cool the welding member until a predetermined temperature is reached.

32. The method of claim 26, comprising a step of instantaneously detecting a temperature of at least part of the welding member.

* * * * *